US009045274B2

(12) United States Patent
Matye

(10) Patent No.: US 9,045,274 B2
(45) Date of Patent: Jun. 2, 2015

(54) MULTI-CHAMBER CONTAINER FOR BULK MATERIALS, AND METHOD OF FILLING A MULTI-CHAMBER CONTAINER

(76) Inventor: Reinhard Matye, Charlevoix, MI (US)

( * ) Notice: Subject to any disclaimer, the term of this patent is extended or adjusted under 35 U.S.C. 154(b) by 109 days.

(21) Appl. No.: 13/599,036

(22) Filed: Aug. 30, 2012

(65) Prior Publication Data

US 2013/0056472 A1 Mar. 7, 2013

Related U.S. Application Data

(60) Provisional application No. 61/528,958, filed on Aug. 30, 2011.

(51) Int. Cl.

| | |
|---|---|
| ***B65D 30/22*** | (2006.01) |
| ***B65D 88/16*** | (2006.01) |
| ***B65B 39/06*** | (2006.01) |
| *B65D 33/00* | (2006.01) |
| *B65D 37/00* | (2006.01) |
| *B65B 1/00* | (2006.01) |
| *B65B 39/00* | (2006.01) |

(52) U.S. Cl.

CPC ..... *B65D 88/1643* (2013.01); *B65D 33/008* (2013.01); *B65D 37/00* (2013.01); *B65B 39/06* (2013.01); *B65B 1/00* (2013.01); *B65B 2039/009* (2013.01); *B65B 2220/18* (2013.01); *B65B 2230/02* (2013.01)

(58) Field of Classification Search

CPC ..... B65D 37/00; B65D 33/008
USPC ..... 206/568, 219; 383/38–40
See application file for complete search history.

(56) References Cited

U.S. PATENT DOCUMENTS

| | | | | |
|---|---|---|---|---|
| 2,522,200 | A * | 9/1950 | Southwick, Jr. | 53/449 |
| 3,867,970 | A | 2/1975 | Winchester, Sr. | |
| 3,945,562 | A * | 3/1976 | Brockmuller | 383/54 |
| 4,540,089 | A * | 9/1985 | Maloney | 206/219 |
| 4,763,702 | A | 8/1988 | High, Jr. et al. | |
| 4,776,455 | A * | 10/1988 | Anderson et al. | 206/0.5 |
| 5,121,775 | A | 6/1992 | McClain | |

(Continued)

FOREIGN PATENT DOCUMENTS

WO 2008137036 A1 11/2008

OTHER PUBLICATIONS

U.S. Appl. No. 13/599,024, filed Aug. 30, 2012.

(Continued)

*Primary Examiner* — Anthony Stashick
*Assistant Examiner* — James Way
(74) *Attorney, Agent, or Firm* — Gardner, Linn, Burkhart & Flory, LLP

(57) ABSTRACT

A multi-chamber container includes at least two sections for storing at least two separate bulk materials in isolation from one another, and/or in isolation from environmental elements such as water or humidity, and/or in isolation from other chemicals. The container may include at least two separate openable apertures or regions for dispensing the respective bulk materials separately or simultaneously, and may be filled in a manner that surrounds one bulk material with another, but isolates the bulk materials from one another while they are in the container. The container permits flexibility in storage and handling of the bulk materials, which are substantially prevented from premature chemical reactions or undesired exposure to environmental elements or chemicals.

15 Claims, 11 Drawing Sheets

(56) References Cited

U.S. PATENT DOCUMENTS

| | | | | |
|---|---|---|---|---|
| 5,219,373 | A | 6/1993 | Hatakeyama et al. | |
| 5,425,403 | A | 6/1995 | Herrmann | |
| 5,529,396 | A * | 6/1996 | Pryor et al. | 383/111 |
| 5,535,792 | A | 7/1996 | McGregor | |
| 5,957,172 | A | 9/1999 | DeGreef et al. | |
| 6,112,956 | A | 9/2000 | Malone | |
| 6,158,623 | A | 12/2000 | Benavides et al. | |
| 6,269,849 | B1 | 8/2001 | Fields, Jr. | |
| 6,298,984 | B1 * | 10/2001 | Weaver et al. | 206/222 |
| 6,662,528 | B2 | 12/2003 | Holt et al. | |
| 6,868,650 | B2 | 3/2005 | Sanchez | |
| 6,905,323 | B2 | 6/2005 | Keller | |
| 6,978,812 | B2 | 12/2005 | Summerville | |
| 7,243,788 | B2 * | 7/2007 | Schmidt et al. | 206/221 |
| 2008/0016825 | A1 | 1/2008 | Mandzsu, Sr. et al. | |
| 2010/0118640 | A1 | 5/2010 | Matye et al. | |
| 2011/0286687 | A1 * | 11/2011 | Pienaar et al. | 383/37 |
| 2012/0070105 | A1 * | 3/2012 | Abel | 383/120 |

OTHER PUBLICATIONS

International Search Report and Written Opinion from corresponding Patent Cooperation Treaty Application No. PCT/US2012/53108, dated Dec. 20, 2012, which corresponds to U.S. Appl. No. 13/599,036.

* cited by examiner

MULTI-CHAMBER CONTAINER FOR BULK MATERIALS, AND METHOD OF FILLING A MULTI-CHAMBER CONTAINER

CROSS REFERENCE TO RELATED APPLICATION

The present application claims the benefit of U.S. provisional application Ser. No. 61/528,958, filed Aug. 30, 2011, which is hereby incorporated herein by reference in its entirety.

FIELD OF THE INVENTION

The present invention relates generally to containers, and in particular, to containers for storing bulk materials.

BACKGROUND OF THE INVENTION

Containers for certain types of bulk materials, such as sand, gravel, and the like, are often in the form of large bags made of woven fabric. Typically, fabric bags intended for containing bulk materials have open top portions to facilitate filling and emptying the bags. Woven fabric bags are generally porous and permit fluids to pass through the fabric material. Thus, such bags may not be suitable for containing bulk materials that are sensitive to moisture.

SUMMARY OF THE INVENTION

The multi-chamber bulk material container of the present invention is adapted for containing different bulk materials in isolation from one another, particularly when at least one of the bulk materials is sensitive to environmental elements (e.g., moisture or airborne contaminants) or to contamination or contact with other bulk material(s). The container may be particularly well suited for containing the component bulk materials of concrete, so that the unmixed concrete may be stored outdoors and/or in the presence of moisture or humidity, substantially without risk of premature curing of the cement binder component of the concrete mixture. By containing the moisture-sensitive cement binder material in a moisture-impervious sack or liner, which maintains the cement binder in isolation and separate from the aggregate component of the concrete mixture during storage, the cement binder will not be activated by moisture from rain, standing water or humidity, or from moisture present in the aggregate portion of the premix concrete. The bulk material container includes open top portions to facilitate filling the container from above, and further includes one or more openable apertures along a bottom surface to facilitate dispensing the bulk materials from the container.

According to one form of the present invention, a multi-chamber bulk material container includes a primary container and a secondary container that is disposed at least partially inside of the primary container. The primary container includes at least one side surface and a bottom surface defining a first chamber for containing a first bulk material. The bottom surface of the primary container is capable of expunging or dispensing at least the first bulk material from the first chamber of the primary container. The secondary container defines a second chamber within the primary container for containing a second bulk material, and includes a closeable aperture for receiving the second bulk material. The secondary container further includes its own openable aperture for selectively expunging the second bulk material from the second chamber defined by the secondary container.

In one aspect, the secondary container is made of a moisture-resistant or moisture-impervious material. Optionally, the primary container is made of a fabric material that is porous or breathable.

In another aspect, the primary container includes a bulkhead spanning between opposing portions of the at least one side surface in order to define first and second portions of the primary container. The first portion receives the first bulk material and the second portion receives the secondary container and the second bulk material contained therein.

In yet another aspect, the bottom surface of the primary container includes a second openable aperture that is generally aligned with the openable aperture of the secondary container, the second openable aperture of the primary container being configured to selectively dispense the second bulk material. Optionally, the primary container has an open top portion.

In a further aspect, the closeable aperture of the secondary container comprises one of a heat-sealable seam, an ultrasonically-welded seam, and an interlocking seam. The seam of the closeable aperture may be moisture-resistant and/or chemical-resistant and/or gas-impervious. Optionally, the second container is made of a polymeric film material that is moisture-resistant and/or chemical-resistant and/or gas-impervious.

In still another aspect, the lower openable aperture of the secondary container is part of a folded lower end portion of the secondary container, so that when the lower end portion is unfolded, the aperture is opened for dispensing the second bulk material.

In another aspect, the bottom surface of the primary container includes an openable aperture for selectively dispensing the first bulk material. Optionally, the bottom surface of the primary container may be readily cut to form an aperture for dispensing.

According to another form of the present invention, a multi-chamber bulk material container includes a primary container having at least one sidewall and a bottom wall defining a first chamber for holding a first bulk material, and a secondary container at least partially positioned in the first chamber of the primary container. The secondary container defines a second chamber for holding a second bulk material and is made from a sealable and moisture resistant liner with closeable upper and lower end portions. The lower end portion of the secondary container is foldable and is held closed by the first bulk material in the first chamber of the primary container. The bottom wall of the primary container is openable to dispense at least the first bulk material from the first chamber. The secondary container isolates the second bulk material from the first bulk material in the first chamber and/or from one or more other contaminants from outside the secondary container. Optionally, the lower end portion of the secondary container is generally funnel-shaped.

According to another form of the present invention, a method is provided for filling a multi-chamber bulk material container. The method includes (i) positioning a multi-chamber bulk material container at a filling apparatus, the multi-chamber bulk material container including a primary container defining a primary chamber and a secondary container positioned in the primary chamber, (ii) dispensing a first amount of a first bulk material into the primary chamber of the multi-chamber bulk material container until at least a closed lower end portion of the secondary container is surrounded by the first bulk material, (iii) dispensing a second bulk material into the secondary container, whereby at least a portion of the second bulk material is positioned above the first amount of the first bulk material that is in the primary chamber, (iv)

dispensing a second amount of the first bulk material into the primary chamber of the multi-chamber bulk material container until at least a portion of the second bulk material is surrounded by the second amount of the first bulk material in the primary chamber, and (v) closing an upper end portion of the secondary container in order to isolate the second bulk material in the secondary container from at least one of (a) the first bulk material in the primary first chamber, and (b) a contaminant from outside of the primary container and the secondary container.

Thus, the present invention provides a multi-chamber container that receives, stores, and dispenses two different bulk materials, maintains the two different bulk materials in isolation from one another during storage, and provides for separate dispensing of the first and second bulk materials from their respective chambers. The secondary container for receiving the second bulk material, in particular, may be moisture resistant and/or chemical resistant in order to prevent premature, uncontrolled, or undesirable chemical reactions of the second bulk material, such as hardening.

These and other objects, advantages, purposes and features of the present invention will become apparent upon review of the following specification in conjunction with the drawings.

DESCRIPTION OF THE PREFERRED EMBODIMENTS

The present invention is directed to a multi-chamber container for storing and dispensing different bulk materials. For example, the present invention may be particularly well suited to storing and dispensing complimentary bulk materials, such as the separate components of concrete, including cement binder and a blend of sand and aggregate (typically natural or man-made gravel or the like). While the present invention is described primarily with reference to a multi-chamber container for containing the bulk material components of concrete, it should be understood that the same or similar principles may be used for other containers for storing and dispensing other materials such as grains, pelletized plastics, chemicals in granular form, and the like.

Figure 1:
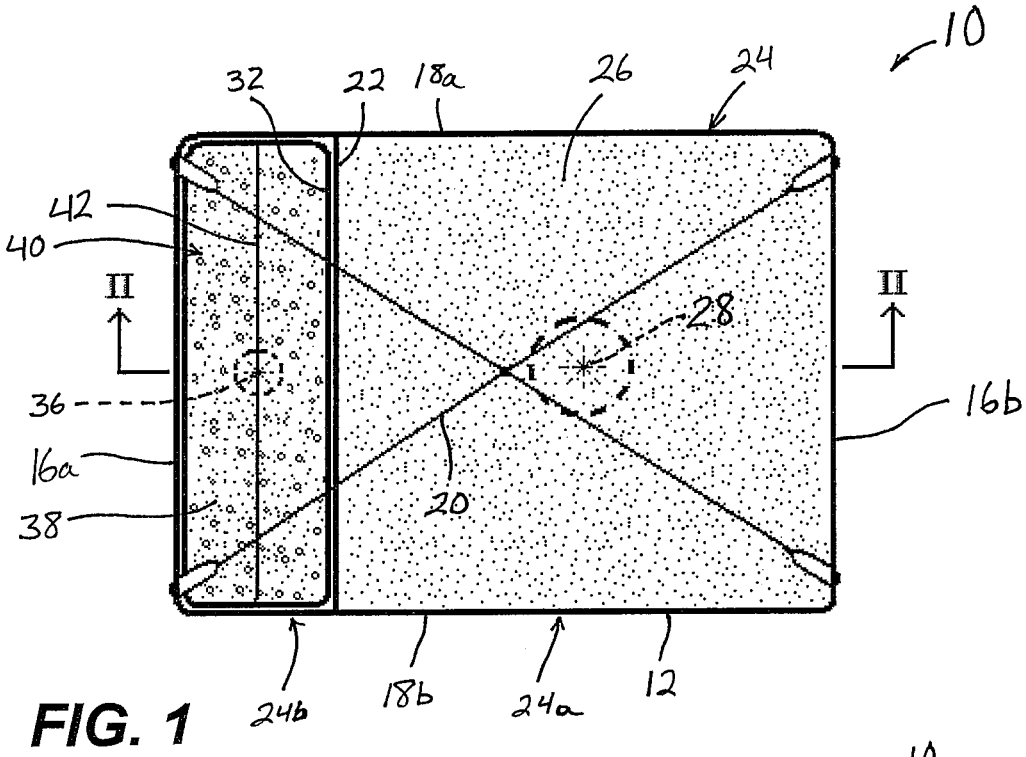
FIG. 1 is a top plan view of a multi-chamber bulk material container in accordance with the present invention.
Figure 2:
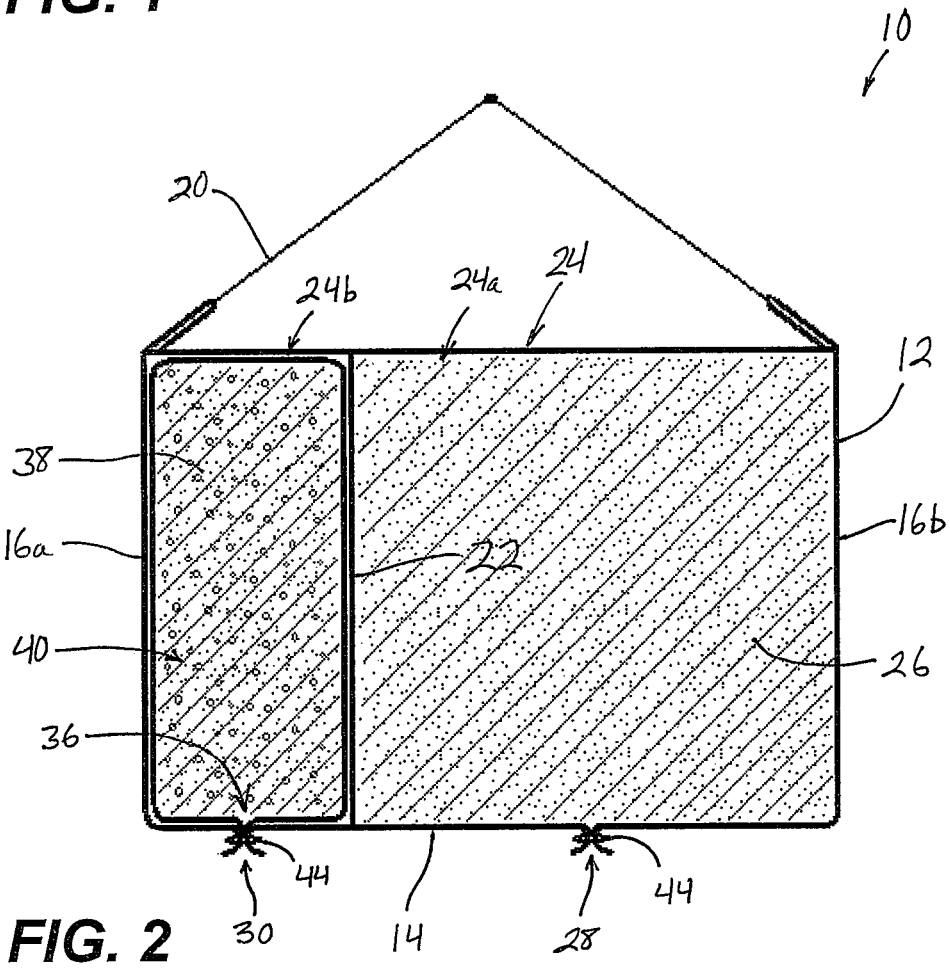
FIG. 2 is a side sectional view of the multi-chamber bulk material container taken along section II-II of FIG. 1.

Referring now to FIGS. 1 and 2, a multi-chamber bulk material container 10 comprises a primary container 12 in the form of a fabric bag having a bottom panel 14 and four upstanding side panels including two opposing end panels 16*a*, 16*b* and two opposing side panels 18*a*, 18*b*. Optionally, a pair of support straps 20 may be provided to facilitate supporting primary container 12 in a suspended manner. End panels 16*a*, 16*b* and side panels 18*a*, 18*b* define a first bulk chamber 24 for receiving a first bulk material 26. In the illustrated embodiment, a fabric wall or bulkhead 22 spans between opposing side panels 18*a*, 18*b*, and is spaced inwardly from end panel 16*a*. Bulkhead 22 divides first bulk chamber 24 into a first portion 24*a* and a second portion 24*b* that are located side-by-side. First bulk material 26 is received in first portion 24*a*, which is defined between bulkhead 22, end panel 16*b*, and portions of side panels 18*a*, 18*b*.

Bottom panel 14 of primary container 12 includes a first openable aperture 28 corresponding to first portion 24*a* of first bulk chamber 24, and a second openable aperture 30 corresponding to the second portion 24*b* of first bulk chamber 24. First openable aperture 28 and second openable aperture 30 are held closed by respective clamps or bands 44 that are disposed tightly around excess material of bottom panel 14, which defines the apertures 28, 30. Bands 44 may be in the form of elastic bands, metal clamps, drawstrings, or the like, and may be removed or loosened to open the apertures 28, 30.

In the illustrated embodiment, primary container 12 is generally rectangular in shape. However, it will be appreciated that the end panels 16*a*, 16*b*, side panels 18*a*, 18*b*, and bottom panel 14 may typically flex or bow outwardly when the primary container is made of flexible material and filled with bulk materials so that the primary container may assume a more rounded shape than shown in the drawings. It will further be appreciated that other shapes of primary containers may be used, such as round (i.e. a single side panel forming a loop) or polygonal shapes, without departing from the spirit and scope of the present invention. In addition, the various panels of primary container 12 (and support straps 20) may be sewn together along abutting edges to form the primary container, although other methods of fastening are envisioned, such as rivets, zippers, heat-bonding, adhesives, or the like. The primary container may alternatively be made of a single panel having regions that serve as bottom and side portions when the primary container is filled.

Primary container 12 may be made from substantially any fabric material that is sufficiently strong to support the weight of the bulk materials contained therein, and of sufficiently low porosity to substantially resist leakage of the bulk materials. At least some level of porosity may be desirable, however, such as to permit drainage of liquids (e.g. rainwater) that may inadvertently enter the primary container. For example, woven fabric of natural or synthetic fibers may be suitable for such applications. It will further be appreciated that rigid or semi-rigid materials may be used for constructing multi-chamber containers that tend to hold a generally fixed shape, which may not be considered "bags" per se, but which would remain within the spirit and scope of the present invention.

Figure 4:
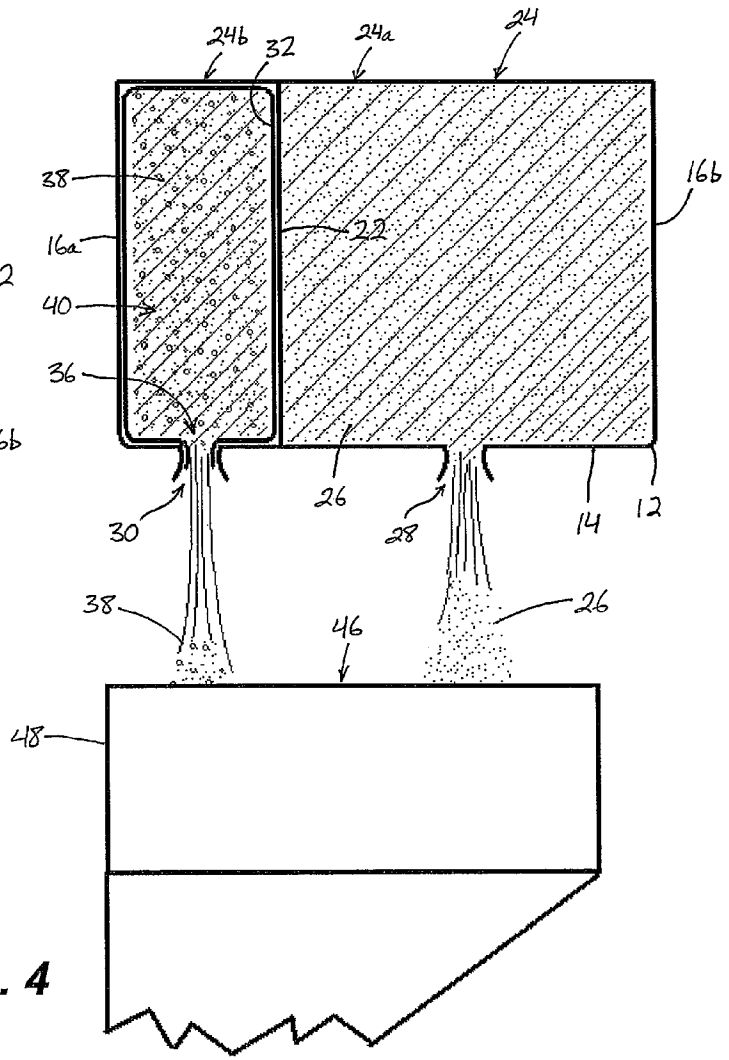
FIG. 4 is a side sectional view of the multi-chamber bulk material container of FIG. 1, showing a dispensing process.
Figure 3:
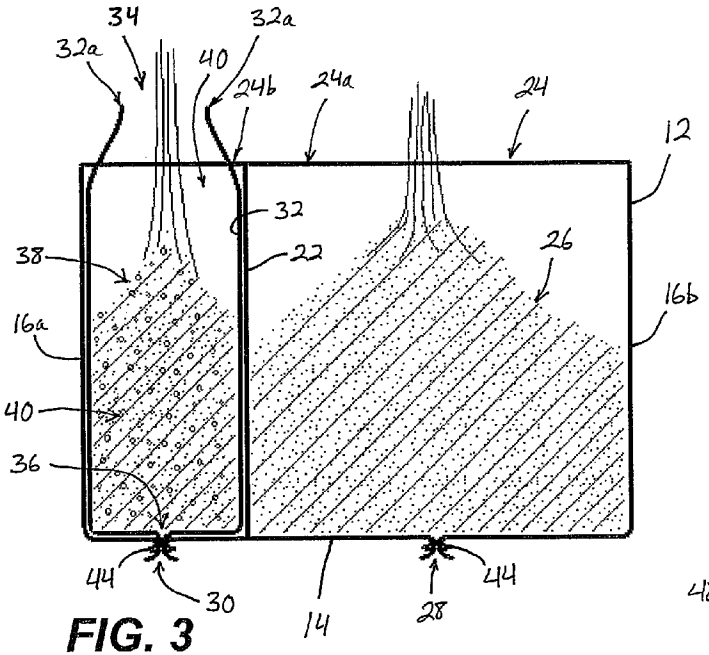
FIG. 3 is a side sectional view of the bulk material container of FIG. 1, showing a filling process.

A secondary container 32 in the form of a bag or liner is positioned in the second portion 24*b* of first bulk chamber 24 defined between bulkhead 22, end panel 16*a*, and portions of side panels 18*a*, 18*b*. Secondary container 32 includes a first or upper sealable aperture 34 (FIG. 3) and a second or lower openable aperture 36. As best seen in FIGS. 1, 3, and 4, lower openable aperture 36 of secondary container 32 is generally aligned with second openable aperture 30 of primary container 12. Upper sealable aperture 34 is defined by an upper end perimeter 32*a* of secondary container 32, the end perimeter 32*a* being sealable to form a seam 42 (FIG. 1) along the top of secondary container 32. Seam 42 may be at least as impervious or resistant to gases, fluids, and chemicals as is the rest of the secondary container 32, and may be formed by heat sealing, ultrasonic welding, with an interlocking seam, or the like.

Secondary container 32 defines a second bulk chamber 40 for containing second bulk material 38 within the second portion 24*b* of first bulk chamber 24 of primary container 12. Secondary container 32 generally maintains the second bulk material 38 in isolation from first bulk material 26 and from environmental elements such as rain and humidity. Secondary container 32 may also serve to prevent the second bulk material contained therein from blowing away if there is wind in the vicinity of bulk material container 10, particularly when the second bulk material is a fine particulate matter and/or of low density. Secondary container 32 may be made from flexible material that is fluid and/or gas impervious and chemical-resistant, such as polymeric film material, which may be particularly desirable when second bulk material 38 is chemically reactive in the presence of moisture, air, or other chemicals with which it is likely to come into contact.

Optionally, the secondary container may be positioned inside the primary container without a bulkhead separating the secondary container from the first bulk material contained loosely within the primary container. In such a configuration, the secondary container may be positioned along one end or side region of the first bulk chamber, or substantially anywhere in a middle region of the first bulk chamber, and may be aligned with a second openable aperture in the primary container (similar to second openable aperture 30) or may instead be aligned with a first or sole openable aperture in the primary container. Additionally, rather than having a lower openable aperture in the secondary container, the secondary container may simply be split or cut open as desired to dispense the second bulk material therefrom. Similarly, it is envisioned that the primary container may be split or cut open as desired to dispense the first bulk material (and optionally, the second bulk material as well) from the resultant opening(s).

It will be appreciated that multi-chamber bulk material containers of the present invention may define three or more chambers for containing three or more separate bulk materials and provide at least some level of isolation between the bulk materials. The containers may be equipped with three or more different openable apertures for dispensing different bulk materials. In addition, where a moisture-resistant bag or liner is provided for isolating one or more of the bulk materials, that moisture-resistant bag or liner may be positioned substantially anywhere within the primary container and at least partially surrounded by other bulk material, rather than within a portion separated by a bulkhead or the like. Other variations may be envisioned, including an arrangement in which two or more bulk materials that are isolated while stored in a multi-chamber bulk material container are subsequently dispensed through a single aperture, such as by positioning a secondary container or liner with its openable aperture disposed within the operable aperture of the primary container.

In the illustrated embodiment, first bulk material 26 is a loose concrete aggregate material, such as a mixture of sand and gravel or the like, while second bulk material 38 is a loose cement binder material. It is generally desirable to maintain cement binders in isolation from moisture and humidity prior to mixing with water for activation of the cement's binding properties. By storing the cement binder inside of the secondary container 32, which is substantially impervious to moisture and humidity, the cement binder is not susceptible to premature activation in the presence of atmospheric humidity, moisture present in the aggregate material (i.e. first bulk material 26), rain, or other moisture that may be present in the environment in which bulk material container 10 is stored. Thus, bulk material container 10 permits a desired mixture of different bulk materials to be stored together in a chemically stable manner and substantially without risk of premature chemical reaction or activation of the materials due to exposure to chemicals or environmental elements. It will thus be appreciated that the bulk materials may be stored indefinitely until they are desired for use.

Figure 5:
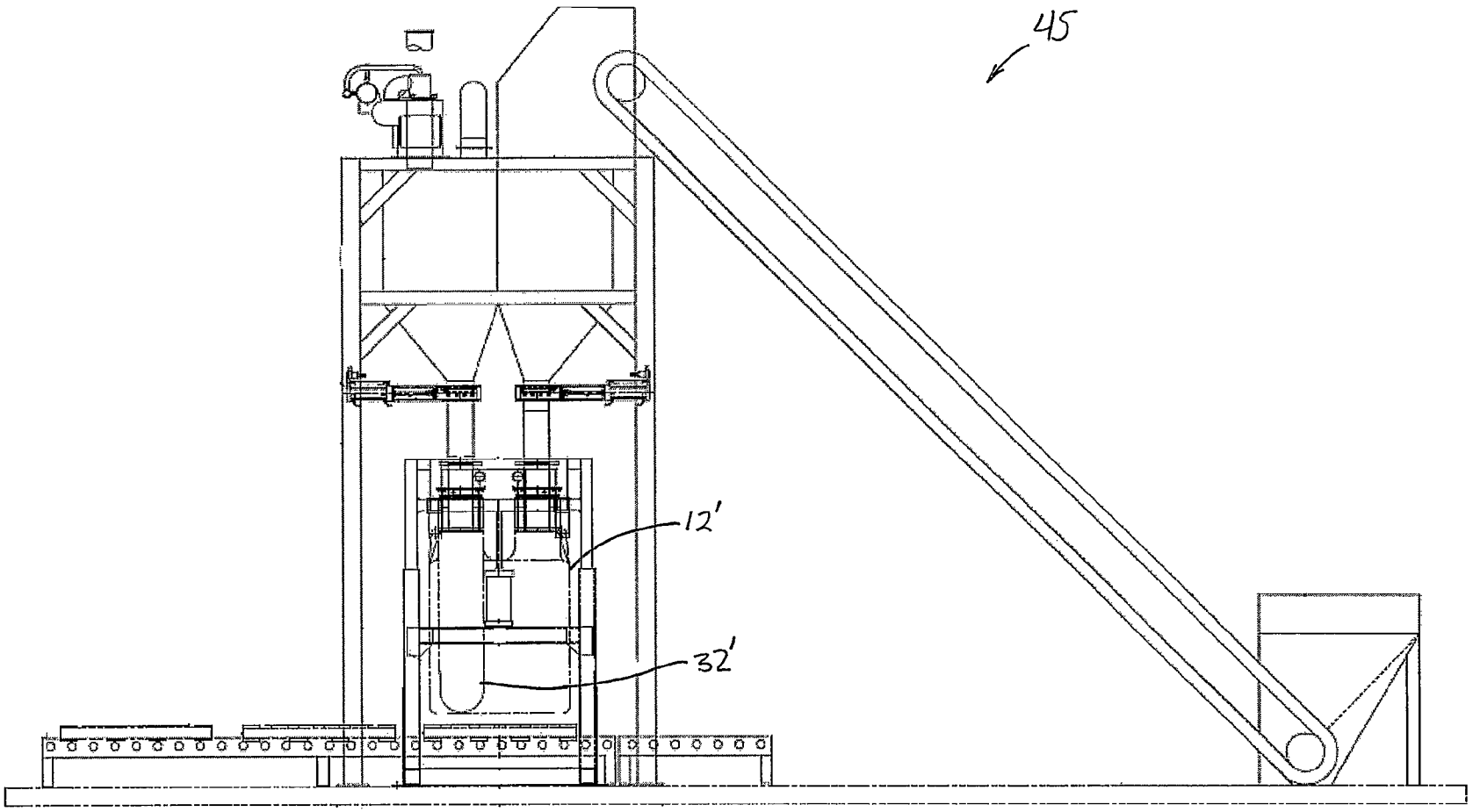
FIG. 5 is a side elevation of one of the multi-chamber bulk material containers of the present invention at a bag filling machine.

Accordingly, first portion 24*a* of first bulk chamber 24 may be filled from above with the first bulk material 26 while the second bulk chamber 40 of secondary container 32 is simultaneously filled from above with the second bulk material 38 (FIG. 3). Bands 44 are clamped or disposed about their respective first and second openable apertures 28, 30 during this filling step, which may be performed on a bag-filling machine 45 (FIG. 5) configured to fill bags 12' with secondary containers 32' disposed therein, such as the filling machine described in a co-pending and commonly-owned U.S. Publication No. 2013/0048148 entitled "APPARATUS AND METHOD FOR FILLING MULTI-CHAMBER CONTAINERS WITH BULK MATERIALS", which claims the priority benefit of U.S. provisional application Serial No. 61/528,966, filed Aug. 30, 2011, which are hereby incorporated herein by reference in their entireties. Once the respective chambers are filled, secondary container 32 is sealed to form seam 42, and the filled bulk material container 10 may be stored indefinitely until the bulk material contents are needed.

First bulk material 26 and second bulk material 38 may be emptied or dispensed from their respective chambers by removing bands 44 from first and second openable apertures 28, 30 of bottom panel 14 of primary container 12. As best seen in FIG. 4, the portion of secondary container 32 that defines lower openable aperture 36 may be aligned with and disposed within second openable aperture 30 so that the band 44 that is disposed about second openable aperture 30 also seals or closes off lower openable aperture 36 of secondary container 32. Thus, both the second openable aperture 30 of bottom panel 14 and the lower openable aperture 36 of secondary container 52 may be opened simultaneously to release second bulk material 38 simply by removing or releasing the corresponding band 44.

When the bulk materials contained in container 10 are desired for use, primary container 12 may be suspended by straps 20 over a receptacle for the bulk materials. For example, when first bulk material 26 comprises concrete aggregate and second bulk material 38 comprises cement binder, bulk material container 10 may be positioned above the inlet 46 of a hopper or funnel 48, such as shown in FIG. 4, and as may be used to direct the bulk materials in to a mixing drum. The bands 44 are removed and both of the bulk materials flow out of their respective chambers and into a desired receptacle, such as funnel 48 (FIG. 4) of a mixing device. The first and second bulk materials may be dispensed substantially simultaneously by removing or loosening the bands simultaneously or, if desired, may be dispensed in sequence by removing or loosening the bands in sequence.

Once the bulk materials have been dispensed from primary container 12 and secondary container 32 in the manner just described, at least primary container 12 may be reused by replacing bands 44 about first and second openable apertures 28, 30. Secondary container 32 may be considered disposable, or optionally may be reusable, such as by closing the lower openable aperture 36 in the second openable aperture 30 of bottom panel 14 of primary container 12, and by breaking or opening the seam 42 to permit refilling of the secondary container 32. Bulk material container 10 may also be suitable for use with mobile concrete mixing plants, such as may be similar to those disclosed in co-pending, commonly assigned, U.S. patent application Ser. No. 12/434,342, filed May 1, 2009 (U.S. Publication No. 2010/0118640), which is hereby incorporated herein by reference in its entirety.

Optionally, and with reference to FIGS. 6-12, another multi-chamber bulk material container 110 allows for a simplified filling and dispensing procedure, Container 110 includes a primary container in the form of a fabric bag 112 having a bottom panel 114. Primary container 112 defines a primary chamber 124 for holding a first bulk material 126 (FIGS. 7-11). A moisture-resistant secondary container 132 is positioned in primary chamber 124 and defines a secondary chamber 140 for holding a second bulk material 138 (FIGS. 8-12). Support straps 120 are sewn or joined to primary container 112 to facilitate supporting primary container 112 in a suspended manner.

Secondary container 132 has an upper portion 132*a* and a lower portion 132*b*. Upper portion 132*a* defines an open mouth for receiving second bulk material 138, and may be closeable and/or sealable (FIGS. 13C-G) after filling to prevent moisture or other contaminants from entering secondary chamber 140. Lower portion 132*b* is generally funnel-shaped and includes a sloped bottom surface or end 150, and an opening 136 along at least a lower portion of the sloped end 150. Sloped end 150 is angled sufficiently from horizontal that when the second bulk material 138 is permitted to flow out of secondary container 132, substantially all of second bulk material 138 will tend to slide downwardly along sloped end 150 until reaching and being dispensed through opening 136. Lower portion 132*b* also includes a foldable region 152, which includes opening 136, and which allows the opening 136 to be closed off during storage of the filled multi-chamber bulk material container 110, as will be described below. Typically, foldable region 152 is folded prior to filling secondary container 132 with second bulk material 138, and automatically unfolds to allow second bulk material 138 to dispensed through opening 136 once lower portion 132*b* is no longer supported by first bulk material 126, as will also be described below. While foldable region 152 is arranged on a diagonal so that it is substantially parallel to sloped bottom surface 150 in FIGS. 6-12, it will be appreciated that other folds or foldable regions are possible, such as a horizontal foldable region 152' (FIGS. 6-13D).

Figure 7:
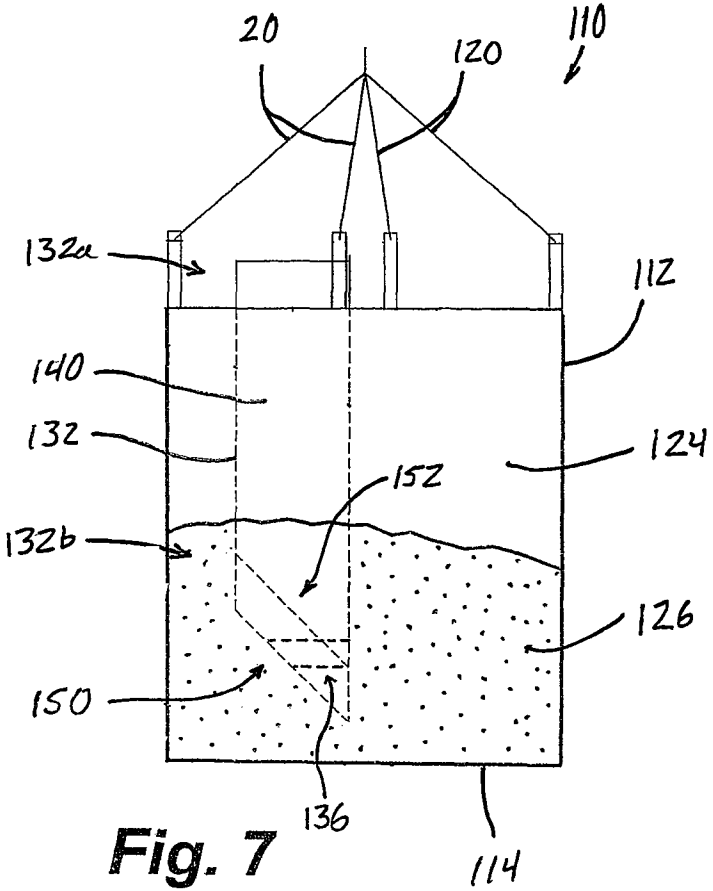
FIG. 7 is another side elevation and partial sectional view of the container of FIG. 6, shown with the container's primary chamber partially filled with a first bulk material.
Figure 6:
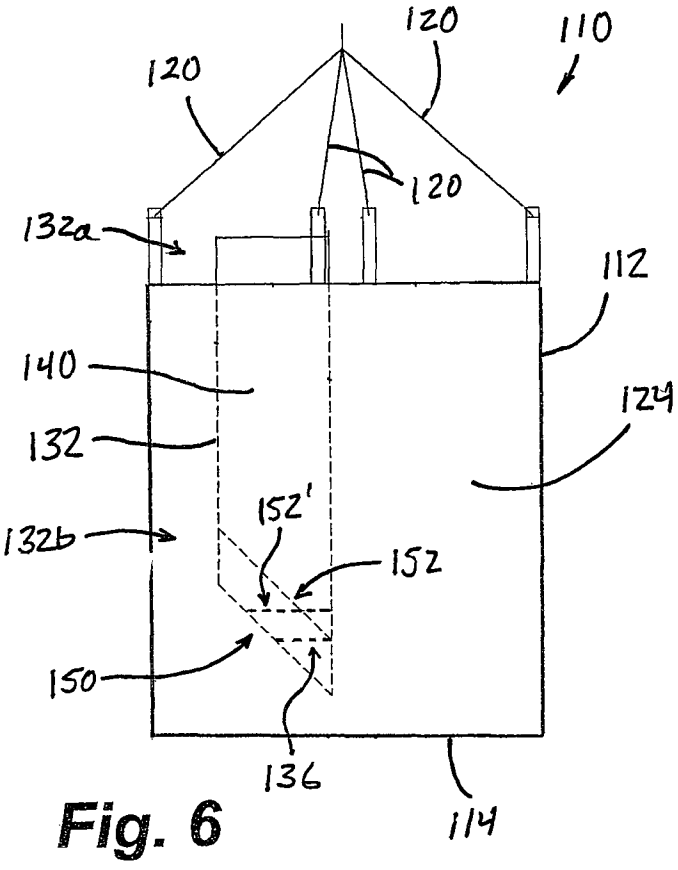
FIG. 6 is a side elevation and partial sectional view of another multi-chamber bulk material container in accordance with the present invention, shown with the container empty.
Figure 13C:
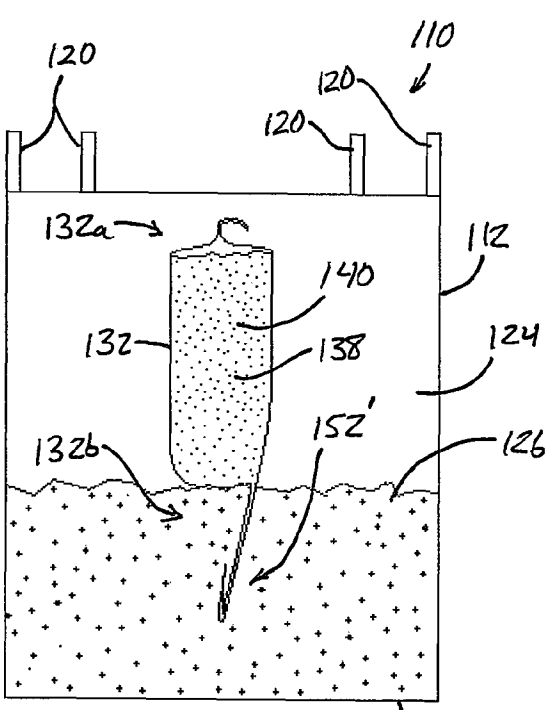
FIGS. 13A-G are end elevation views of the container of FIG. 6, showing sequential steps of filling and emptying the container.
Figure 13B:
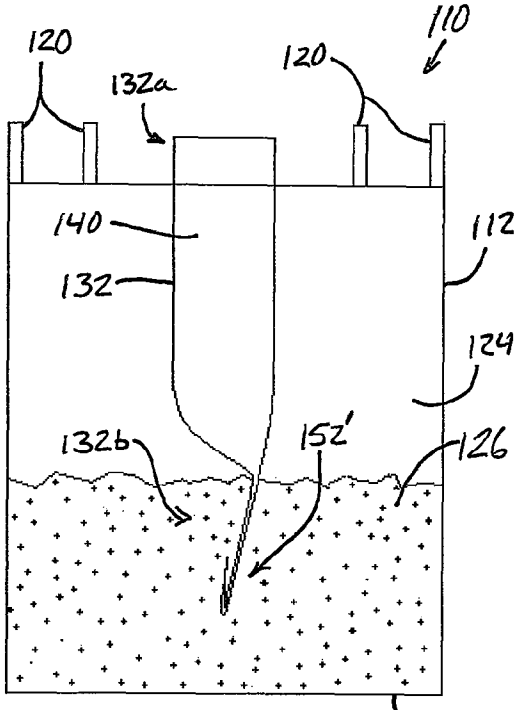
Figure 13A:
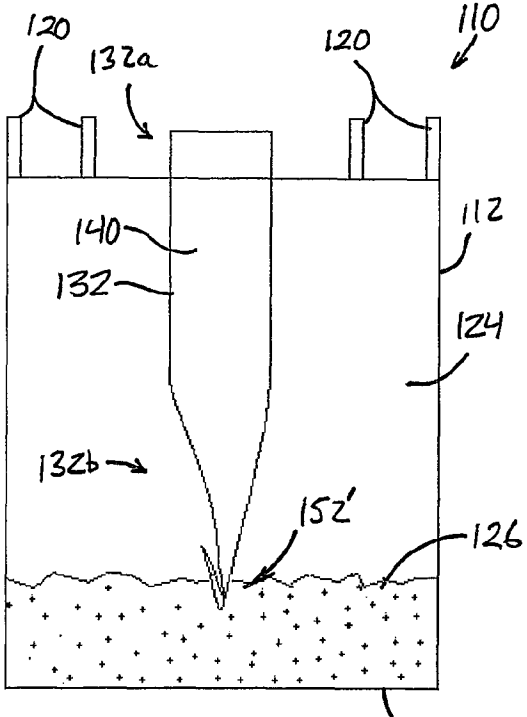

To fill multi-chamber bulk material container 110 with bulk materials 126, 138, primary chamber 124 is partially filled with first bulk material 126 until foldable region 152, 152' of secondary container 132 is surrounded by first bulk material 126 (FIGS. 7, 13A, and 13B). It will be appreciated that bulk materials typically exhibit fluid-like properties, including the ability to flow in a somewhat fluid-like manner, to assume the general shape of a container, and exerting fluid-like pressure on the walls of such a container, or on other objects within the container. The pressure exerted on lower portion 132*b* and foldable region 152, 152' by first bulk material 126 is typically sufficient to maintain the foldable region 152, 152' in its folded configuration, and so that secondary chamber 140 has little or no volume in the region of lower portion 132*b* that is initially surrounded by first bulk material 126 (FIGS. 13B-D). This limits or prevents the first bulk material 126 or other contaminants from entering secondary chamber 140 through opening 136, since foldable region 152, 152' is maintained in its folded configuration to substantially seal off opening 136.

Figure 9:
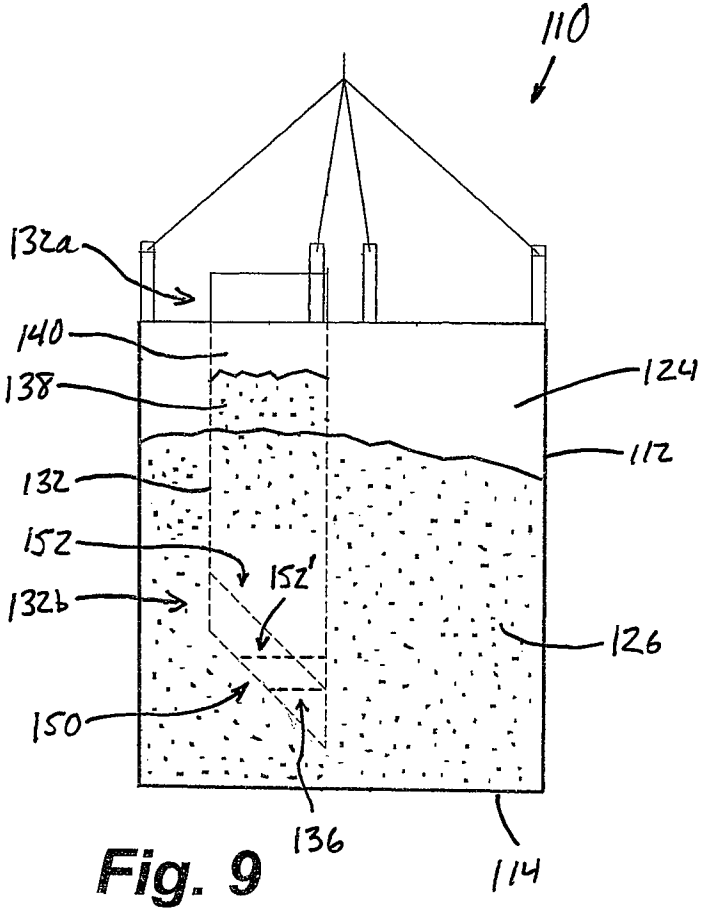
FIG. 9 is another side elevation and partial sectional view of the container of FIG. 6, shown with the container's primary and secondary chambers filled.
Figure 8:
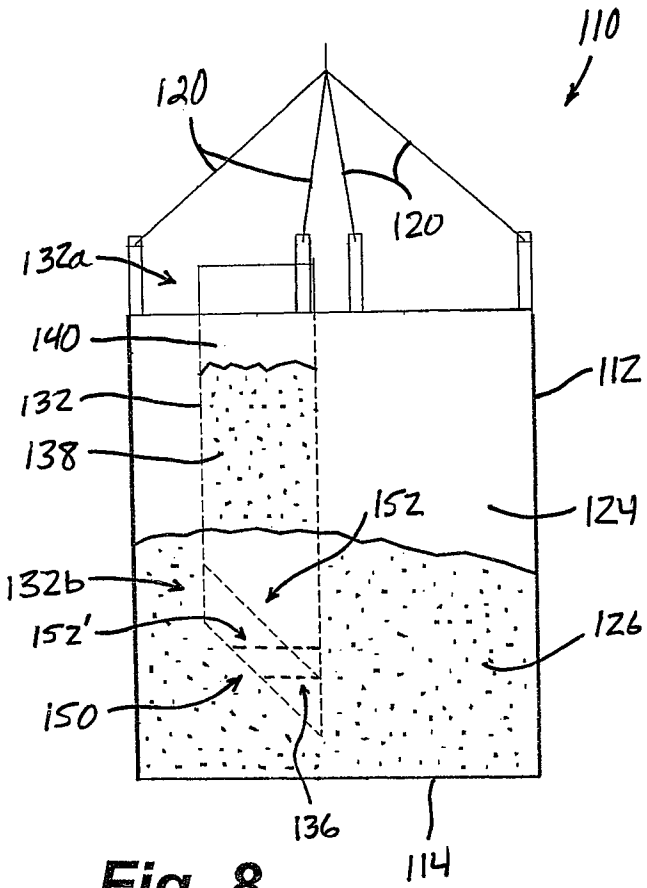
FIG. 8 is another side elevation and partial sectional view of the container of FIG. 6, shown with the container's primary chamber partially filled and the secondary chamber filled with a second bulk material.
Figure 11:
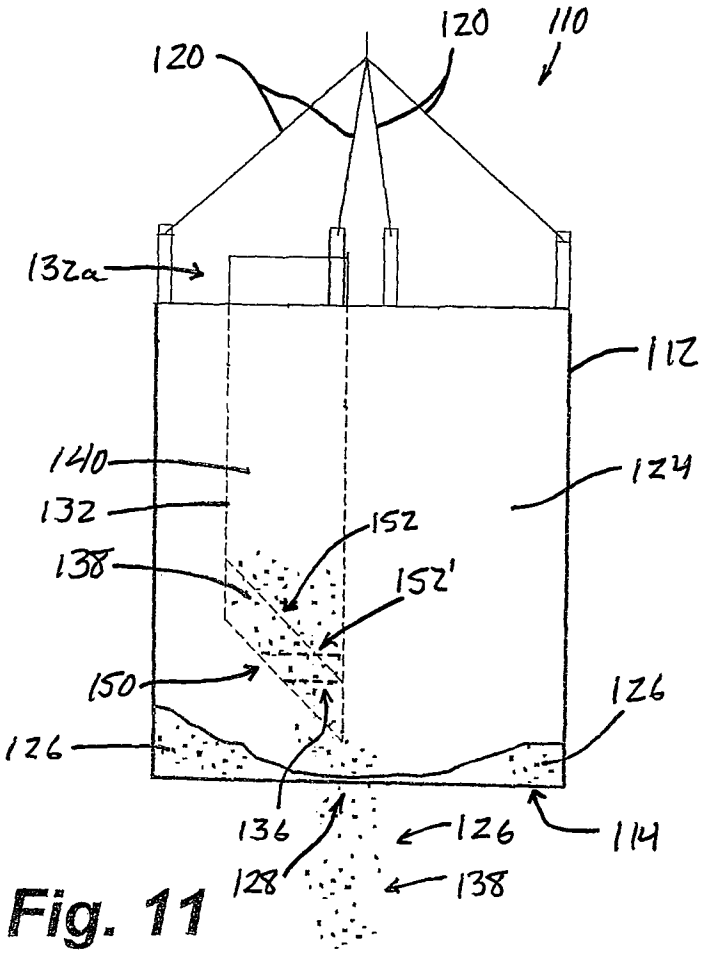
FIG. 11 is another side elevation and partial sectional view of the container of FIG. 6, shown dispensing a remainder of the first bulk material from the primary container and dispensing the second bulk material from the secondary container.

Once primary chamber 124 is partially filled, second bulk material 138 may be added to secondary chamber 140 of secondary container 132 (FIGS. 8 and 13C), Typically, second bulk material 138 will rest atop the top of first bulk material 126, as shown in FIGS. 8 and 13C, since the pressure of first bulk material 126 pinches off secondary container 132 above foldable region 152, 152'. Once second bulk material 138 is added to secondary chamber 140, upper portion 132*a* of container 132 may be sealed (FIG. 13C), such as by heat sealing, ultrasonic welding, engaging an interlocking seam, applying an elastic band, tying, or the like. This may be particularly desirable if second bulk material 138 is sensitive to moisture or other contaminants. The remainder of first bulk material 126 can be added to primary chamber 124 once secondary chamber 140 is filled, so that the first bulk material surrounds at least a portion of the second bulk material (FIGS. 9 and 13D).

Optionally, second bulk material 138 may be added to secondary chamber 140 simultaneously with the addition of the remainder of first bulk material 126 to primary chamber 124, although care should be taken to ensure that the level of first bulk material does not close off secondary chamber 140, especially if first bulk material 126 has a higher density than second bulk material 138 and therefore exerts higher fluid-like pressure than the second bulk material 138. Multi-chamber bulk material container 110 can then be stored indefinitely in the configuration of FIGS. 9 and 13D.

Figure 10:
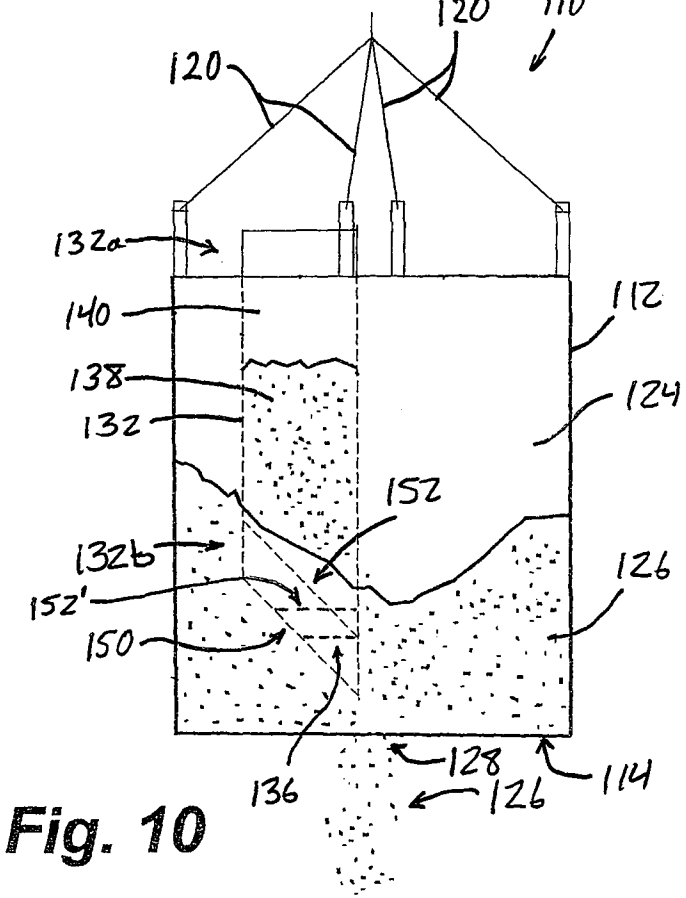
FIG. 10 is another side elevation and partial sectional view of the container of FIG. 6, shown with the container's primary container dispensing the first bulk material.
Figure 12:
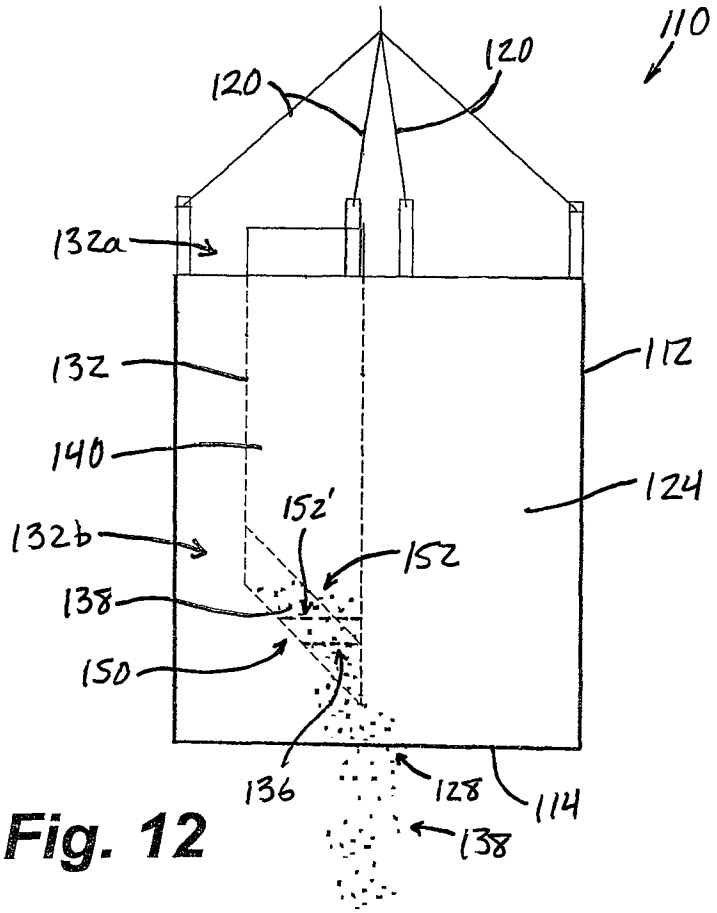
FIG. 12 is another side elevation and partial sectional view of the container of FIG. 6, shown with the container's secondary chamber dispensing the remainder of the second bulk material.
Figure 13E:
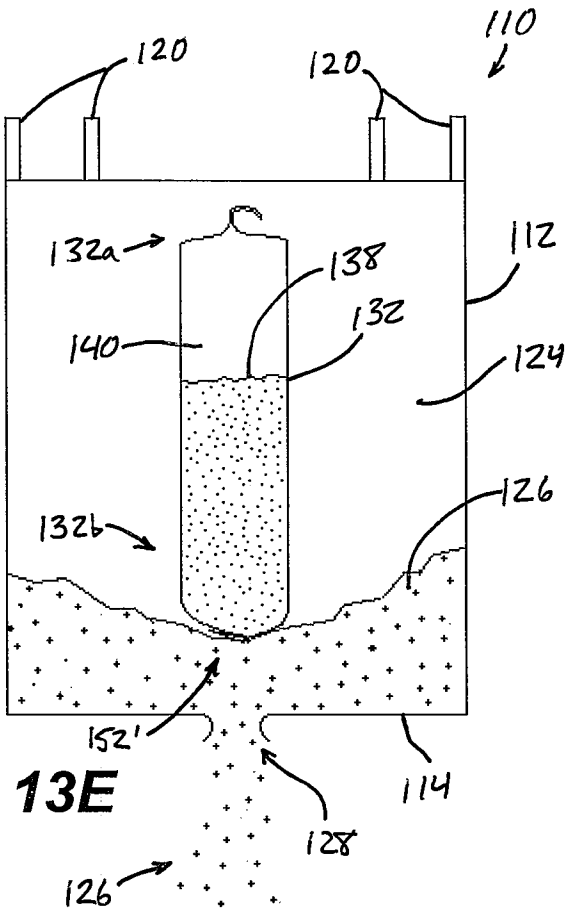
Figure 13D:
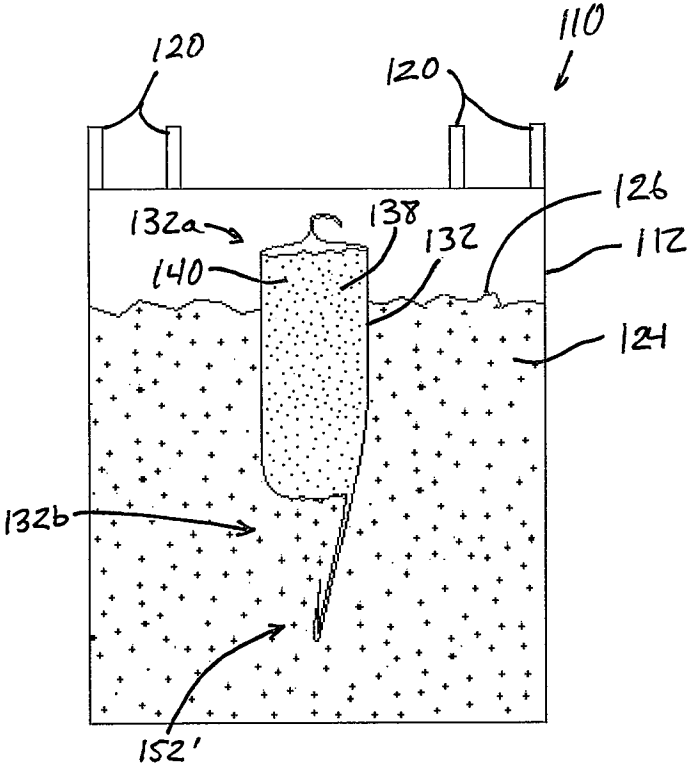
Figure 13G:
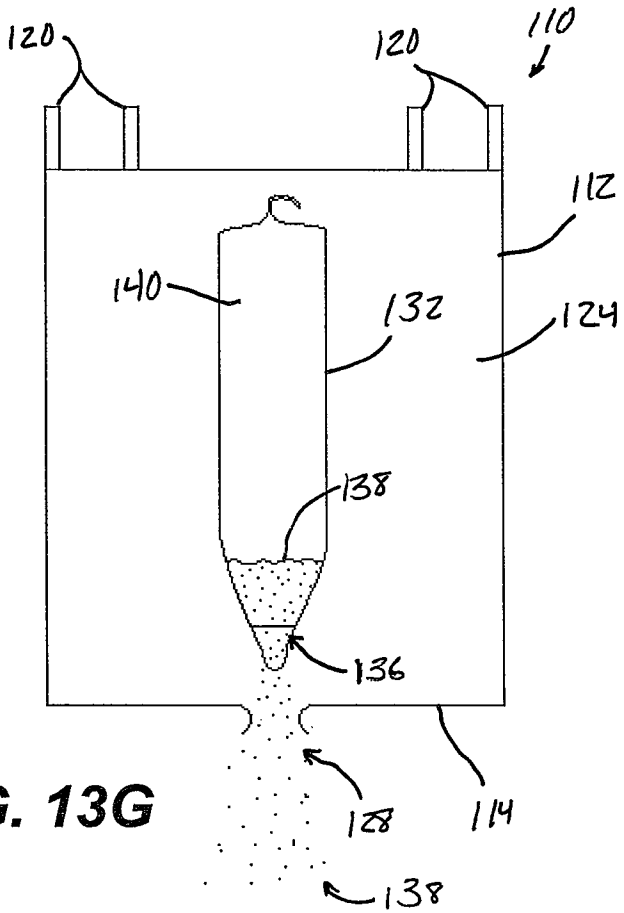
Figure 13F:
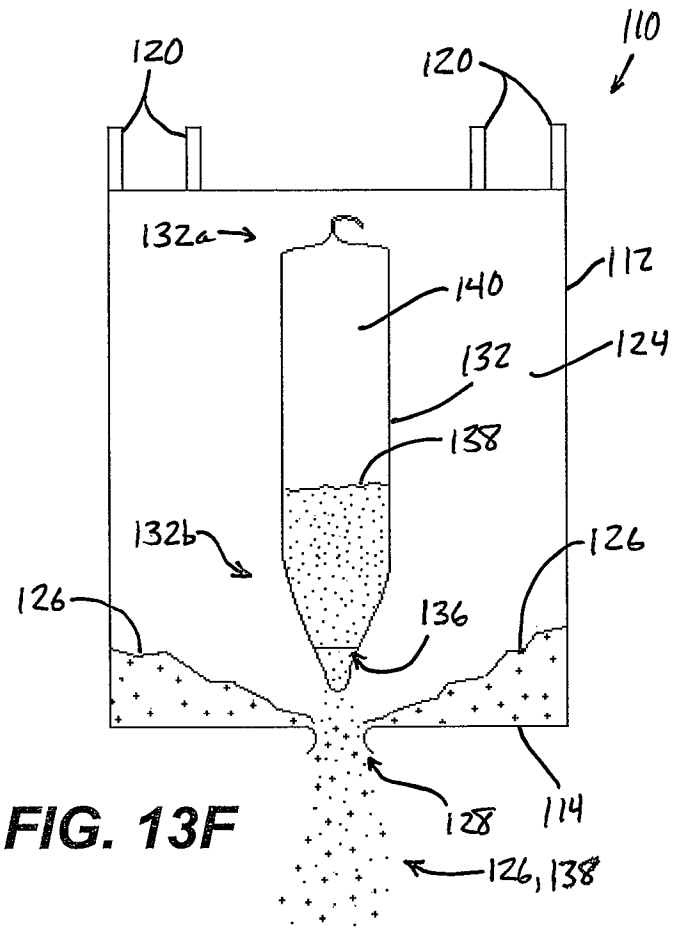

To dispense the bulk materials from multi-chamber bulk material container 110, the container is positioned over a hopper, a mixing drum, or other bulk material-receiving receptacle, and bottom wall 114 is cut or opened (such as at an openable aperture, described above with reference to container 10) to form an opening 128 and release first bulk material 126 from primary chamber 124 (FIGS. 10 and 13E). As the level of first bulk material 126 falls (FIG. 13E as compared to FIG. 13D), foldable region 152, 152' of secondary container 132 becomes uncovered, allowing second bulk material 138 to move down into the lower portion of secondary chamber 140 defined by lower portion 132*b*, which in turn causes foldable region 152, 152' to begin unfolding (FIG. 13E). Once opening 136 is uncovered (FIGS. 11 and 13F), second bulk material 138 begins flowing out of secondary chamber 140 through the opening 136 along sloped end 150, and exits through the opening 128 in bottom wall 114 of primary container 112 (FIGS. 11, 12, 13F, and 13G) as the last of first bulk material 126 is discharged through the same opening. Depending on the rate at which first bulk material 126 and second bulk material 138 are discharged, the last of the second bulk material 138 may be dispensed through opening 136 and then opening 128 after the last of the first bulk material 126 has been discharged through opening 128, such as shown in FIG. 13G.

Figure 14:
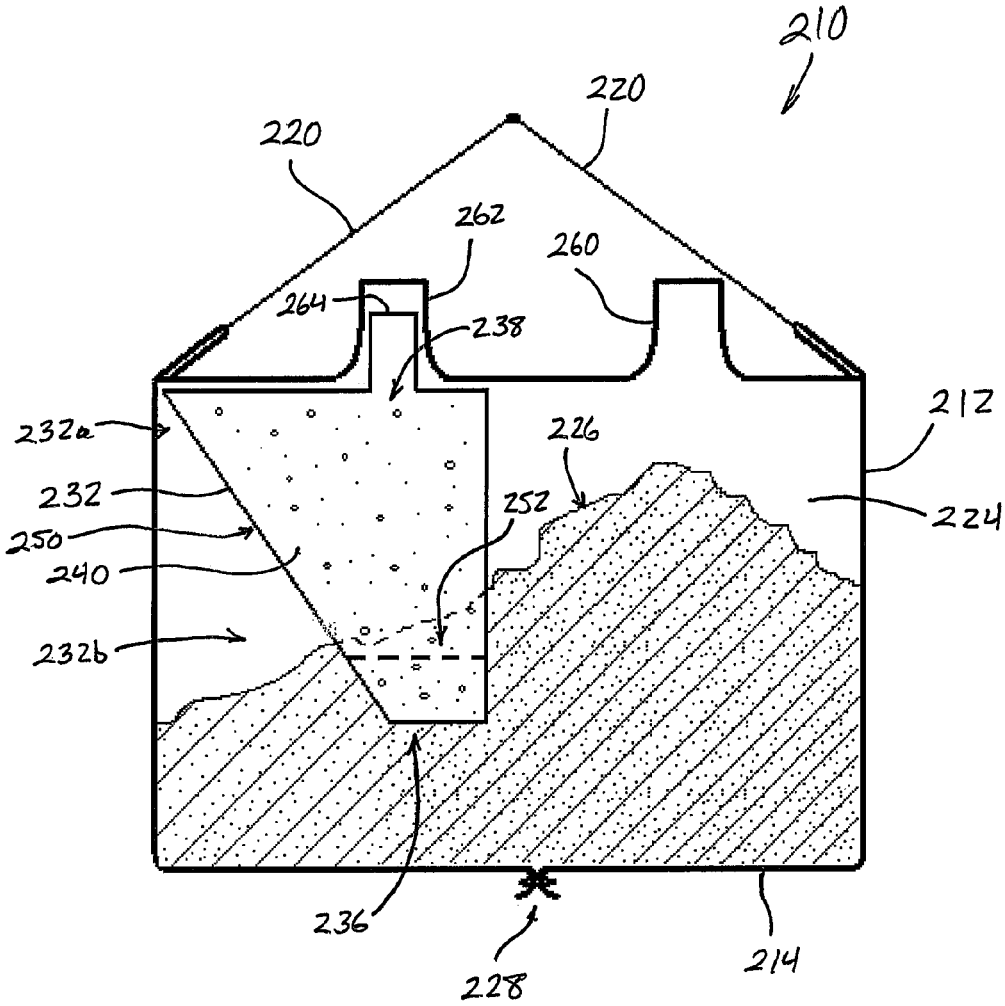
FIG. 14 is a side elevation and partial sectional view of another multi-chamber bulk material container in accordance with the present invention.

Optionally, and with reference to FIG. 14, another multi-chamber bulk material container 210 is similar in many respects to container 110, described above, and includes a primary container in the form of a fabric bag 212 having a bottom panel 214 with a closeable opening 228. Primary container 212 defines a primary chamber 224 for holding a first bulk material 226. A moisture-resistant secondary container 232 is positioned in primary chamber 224 and defines a secondary chamber 240 for holding a second bulk material 238. Support straps 220 are sewn or joined to primary container 212 to facilitate supporting primary container 212 in a suspended manner. In the illustrated embodiment of FIG. 14, fabric bag 212 includes a top panel 260 that defines a first bulk material fill-spout 260 in communication with primary chamber 224 for filling the primary chamber with first bulk material 226, and a second bulk material fill-spout 262 in communication with secondary chamber 240 for filling the secondary chamber with second bulk material 238.

Secondary container 232 has an upper portion 232*a* and a lower portion 232*b*. Upper portion 232*a* defines an open mouth or fill-spout 264 for receiving second bulk material 238, and may be closeable and/or sealable after filling to prevent moisture or other contaminants from entering secondary chamber 240. Substantially all of secondary container 232 below fill-spout 264, including lower portion 232*b*, is generally funnel-shaped and includes a sloped sidewall 250, with an open bottom end portion 236. Sloped end 250 is angled so that when the second bulk material 238 is permitted to flow out of secondary container 232, it is generally directed toward opening 228 in the bottom wall 214 in fabric bag 212. This facilitates dispensing substantially all of second bulk material 238 from secondary container 232 out through opening 236. Lower portion 232*b* also includes a foldable region 252, which allows the opening 236 to be closed off during storage of the filled multi-chamber bulk material container 210, in substantially the same manner as foldable region 152', described above. Typically, foldable region 252 is folded prior to filling secondary container 232 with second bulk material 238, and automatically unfolds to allow second bulk material 238 to dispensed through opening 236 once lower portion 232*b* is no longer supported by first bulk material 226, as will be understood with reference to the above discussion.

Thus, it will be appreciated that the multi-chamber bulk material container of the present invention provides a convenient and stable storage means for different bulk materials, such as materials that should not be premixed or exposed to moisture or other chemicals during storage, or where it is desirable to maintain at least one of the bulk materials in isolation from the other bulk material(s) and/or environmental elements. Bulk materials stored in this manner may be stored in substantially any location without concern for premature activation or reaction of the bulk materials, which may be readily dispensed through apertures in the bottom of the container when their use is desired.

Changes and modifications in the specifically described embodiments can be carried out without departing from the principles of the present invention, which is intended to be limited only by the scope of the appended claims, as interpreted according to the principles of patent law, including the doctrine of equivalents.

The invention claimed is:

1. A multi-chamber bulk material container comprising:

a primary container defining a first bulk chamber configured to contain a first bulk material, said primary container comprising at least one side surface and a bottom surface, said bottom surface having a first openable and closeable aperture configured to selectively dispense the first bulk material and a second openable and closeable aperture spaced from said first openable and closeable aperture and configured to selectively dispense a second bulk material, and said primary container having an open top portion opposite said bottom surface and open to said first bulk chamber;

a moisture-impervious secondary container defining a second bulk chamber at least partially within said primary container and configured to contain the second bulk material, said secondary container comprising a closeable aperture configured to receive the second bulk material and an openable aperture substantially aligned with said second openable and closeable aperture and configured to selectively dispense the second bulk material; and wherein said secondary container is adapted to isolate the second bulk material in said second bulk chamber from at least one of (i) the first bulk material in said first bulk chamber, and (ii) a contaminant from outside of said primary container and said secondary container.

2. The multi-chamber bulk material container of claim 1, wherein said secondary container comprises a polymeric film material.

3. The multi-chamber bulk material container of claim 1, wherein said primary container comprises a fabric material.

4. The multi-chamber bulk material container of claim 1, wherein said primary container comprises a bulkhead spanning between opposing portions of said at least one side surface to define first and second portions of said first chamber, and wherein said first portion is adapted to receive the first bulk material and the second portion is adapted to receive said secondary container.

5. The multi-chamber bulk material container of claim 1, further comprising a band positioned at each of said first and second openable and closeable apertures, wherein said bands are configured to releasably secure respective ones of said first and second openable and closeable apertures in a closed configuration.

6. The multi-chamber bulk material container of claim 1, wherein said closeable aperture of said secondary container comprises at least one chosen from a heat-sealable seam, an ultrasonically-welded seam, and an interlocking seam.

7. The multi-chamber bulk material container of claim 6, wherein said closeable aperture of said secondary container is moisture-resistant.

8. The multi-chamber bulk material container of claim 1, wherein said secondary container comprises a folded lower end portion that includes said openable aperture.

9. The multi-chamber bulk material container of claim 1, wherein said bottom surface of said primary container is configured to be cut open to dispense the first bulk material.

10. A multi-chamber bulk material container comprising:

a primary container comprising sidewalls and a bottom wall cooperating to define first and second chamber portions, wherein said first chamber portion is adapted to contain a first bulk material and said second chamber portion is adapted to contain a second bulk material that is different in composition from the first bulk material;

a first openable and closeable aperture defined in said bottom wall of said primary container at said first chamber portion, said first openable and closeable aperture configured to selectively dispense the first bulk material;

a second openable and closeable aperture defined in said bottom wall of said primary container at said second chamber portion, said second openable and closeable aperture spaced apart from said first openable and closeable aperture and configured to selectively dispense the second bulk material; and a secondary container positioned in said second chamber portion of said primary container, said secondary container comprising a generally sealable and moisture-impervious liner that is openable at a bottom end positioned at said second openable and closeable aperture.

11. The multi-chamber bulk material container of claim 10, wherein said primary container comprises a fabric material, and wherein said secondary container comprises a polymeric film material.

12. The multi-chamber bulk material container of claim 10, wherein said primary container comprises an open top portion that is open to both said first and second chamber portions.

13. A multi-chamber bulk material container comprising:

a primary container comprising at least one sidewall and a bottom wall defining a first chamber for containing a first bulk material, wherein said bottom wall is openable to dispense the first bulk material from the first chamber;

a secondary container positioned in said first chamber of said primary container and defining a second chamber at least partially within said first chamber of said primary container, said secondary container comprising a generally sealable and moisture-resistant liner having closeable openings at upper and lower end portions thereof, wherein said closeable opening at said lower end portion is configured to be folded closed and maintained closed by the first bulk material in said first chamber, and wherein said closeable opening at said lower end portion is configured to reopen by unfolding as a result of dispensing the first bulk material from said first chamber; and wherein said secondary container is configured to isolate the second bulk material in said second bulk chamber from at least one of (i) the first bulk material in said first chamber, and (ii) a contaminant from outside of said primary container and said secondary container.

14. The multi-chamber bulk material container of claim 13, wherein said lower end portion of said secondary container is generally funnel-shaped.

15. The multi-chamber bulk material container of claim 10, wherein said primary container comprises a bulkhead spanning between said first and second chamber portions.

* * * * *